US008235306B2

(12) United States Patent
Schneider

(10) Patent No.: US 8,235,306 B2
(45) Date of Patent: Aug. 7, 2012

(54) WATER CONSERVING DOMESTIC HOT WATER PURGE VALVE

(75) Inventor: Aaron Schneider, Anaheim, CA (US)

(73) Assignee: Aaron Schneider, Anaheim, CA (US)

( * ) Notice: Subject to any disclaimer, the term of this patent is extended or adjusted under 35 U.S.C. 154(b) by 0 days.

(21) Appl. No.: 13/244,459

(22) Filed: Sep. 24, 2011

(65) Prior Publication Data

US 2012/0012198 A1 Jan. 19, 2012

(51) Int. Cl.
*G05D 23/02* (2006.01)
*F16K 17/38* (2006.01)
*A47K 1/00* (2006.01)

(52) U.S. Cl. ..... 236/93 R; 137/468; 4/626

(58) Field of Classification Search ..... 62/93 R, 62/93 B, 99 J, 99 K; 137/468, 872; 4/625, 4/626, 688, 693
See application file for complete search history.

(56) References Cited

U.S. PATENT DOCUMENTS

| | | | | |
|---|---|---|---|---|
| 3,112,497 | A | 12/1963 | Call | |
| 3,188,656 | A | 6/1965 | Drager | |
| 3,594,825 | A | 7/1971 | Reid | |
| 4,162,218 | A | 7/1979 | McCormick | |
| 4,535,813 | A * | 8/1985 | Spain | 137/625.5 |
| 4,554,688 | A * | 11/1985 | Puccerella | 4/668 |
| 4,854,499 | A * | 8/1989 | Neuman | 236/93 B |
| 5,428,850 | A * | 7/1995 | Hiraishi et al. | 4/601 |
| 5,524,666 | A | 6/1996 | Linn | |
| 6,032,687 | A * | 3/2000 | Linn | 137/337 |
| 6,997,200 | B2 | 2/2006 | King | |
| 7,487,923 | B2 | 2/2009 | Willsford | |
| 2008/0061155 | A1 | 3/2008 | Seymour | |
| 2008/0072971 | A1 | 3/2008 | Honeychurch | |
| 2009/0266426 | A1 * | 10/2009 | Lee | 137/337 |

* cited by examiner

*Primary Examiner* — Chen Wen Jiang

(57) ABSTRACT

A purge valve comprising a valve body having a valve inlet and a valve outlet and a water flow passage between the valve inlet and the valve outlet; first valve means adapted to set the valve in open position by opening the water flow passage in response to a user's action; second valve means adapted to hold the valve in open position if and until the water flowing through the water flow passage is below a predetermined temperature; third valve means adapted to automatically set the valve in close position when the water flowing through the water flow passage is at the predetermined temperature; and, fourth valve means adapted to alert the user that the valve has closed and water having the predetermined temperature is available at the valve inlet.

9 Claims, 9 Drawing Sheets

WATER CONSERVING DOMESTIC HOT WATER PURGE VALVE

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISC APPENDIX

Not Applicable

BACKGROUND OF THE INVENTION

1. Field of the Invention

The invention relates to a water and energy conservation system. More particularly, the invention relates to a system for diverting, and/or conserving for subsequent use, low temperature water within a hot water line.

2. Description of the Related Art

In a building domestic hot water system where a recirculation pump is not employed, hot water cools in the piping between the water heater and building hot water fixtures, thus requiring building occupants to purge the cooled water prior to usable hot water becoming available at given outlet. Often the purged water is run unused down the drain. Furthermore, unless running water is closely monitored, hot water may proceed to run unused into drain until user becomes aware that hot water is present (typically by visible steam vapor produced by the hot water). This practice is not only wasting water but also the energy used to heat the water in many buildings and homes. Increased wastewater also unnecessarily burdens our sewer infrastructures and the energy used in pumping and treating said wastewater.

Prior art attempts to solve this problem have failed to gain widespread acceptance due to lack of an effective, logical, and marketable solution to this common and unnecessary problem. For example, one proposed solution was to continually move hot water through a hot water loop via a water pump such that hot water is available within several feet of system fixtures. However, these systems are expensive to install with the additional necessary piping, the pump, and controls. Due the initial costs coupled with energy costs, this approach is typically not well suited for typical residential or small commercial domestic hot water systems.

Furthermore, hot water piping in these applications will experience a relatively high degree of continuous heat loss through the piping insulation causing further energy waste. Moreover, most recirculation systems are not easily adapted to existing building systems due to the necessity of additional return water piping between the furthest fixture and the hot water heater.

Other prior attempts propose to utilize a combination of a hot water recirculation system and thermostatic control device. Whereas standard recirculation systems are quite expensive enough, additional controls only compound first costs.

Another common practice in larger commercial buildings employs the use of multiple instantaneous hot water heaters located at each location in the building. Whereas this may be suitable for larger commercial buildings, this has not been well adapted to other typical applications due to the first costs, electrical consumption, and installation requirements.

Still, other methods of non recirculation hot water conservation systems have been proposed such that water cooled within hot water piping is continually purged and diverted to alternate usage such as specialized water closet storage systems. Such systems continually purge water in hot water piping that is still warm resulting in constant heat loss and a continuous waste of energy. Likewise, such systems may require additional controls to prevent continuous hot water purge operation. The substantial first costs of associated system components and installation limit the benefits of these methods.

Other prior art approaches propose the use of a manual open manual closed hot water bypass valve. When the user requires hot water, they first turn the device to bypass thereby redirecting the cooled water in the hot water lines. Once hot water begins to flow through the device, an indicator changes color signifying hot water is present. At that time, the user can then turn the device from bypass to the on position and water then flows out of the fixture. An issue with this type of valve is that the device must be manually turned off and such a device if left unattended will be left to run continuously thus wasting water and the energy used to heat the water.

Another issue is that a chromatic visible indicator notifies the user when hot water is ready for use; however, if the user does not pay visual attention to the gradually changing temperature indicator, the hot water will proceed to run unused. Furthermore, it is quite possible that the user may mistakenly turn the device to the bypass position believing the valve is in the off position (since flow will have stopped running from the fixture) however allowing hot water to be continually redirected via the bypass, thus, causing waste of water and energy.

Hence, there is a need to conserve water and energy in a time when cost, infrastructure, and environmental factors make it necessary and advantageous to do so. While attempts were made in the past, as described above, there is a need for a new and unique method and system of effectively and automatically purging water from cooled domestic hot water lines on a per use basis and diverting this water for alternate usages. A purge valve of this nature serves to conserve water, energy used in heating water, sewer infrastructure capacities, and additionally, the energy used in pumping and treating wastewater.

The problems and the associated solutions presented in this section could be or could have been pursued, but they are not necessarily approaches that have been previously conceived or pursued. Therefore, unless otherwise indicated, it should not be assumed that any of the approaches presented in this section qualify as prior art merely by virtue of their presence in this section of the application.

BRIEF SUMMARY OF THE INVENTION

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

In one exemplary embodiment a purge valve is configured to open when actuated by a user, to automatically close when the water reached a predetermined temperature and to alert the user that it closed, and thus, that the purging cycle has ended and hot water having desired temperature is available for use. Thus, an advantage is the option to purge the water from the hot water pipe only when hot water is needed and not continuously, which prevents waste of water and energy. Another advantage is the automatic shut off which prevents hot water above a desired/predetermined temperature from being wasted. Another advantage is that it alerts the user when hot water is available, which may prevent delay in using that hot water, which in turn may prevent the loss of heat by that hot water in the respective hot water pipe.

In another exemplary embodiment a purge valve is integrated into a typical water faucet. The result is a "green" faucet which saves water and energy. Thus, an advantage is the opportunity given to a user to install this green faucet during new construction or remodeling.

In another exemplary embodiment the purge valve works in conjunction with a hot water source, a water fixture and an alternative use conduit to achieve a water and energy conservation system.

The above embodiments and advantages, as well as other embodiments and advantages, will become apparent from the ensuing description and accompanying drawings.

BRIEF DESCRIPTION OF THE DRAWINGS

For exemplification purposes, and not for limitation purposes, embodiments of the invention are illustrated in the figures of the accompanying drawings, in which.

DETAILED DESCRIPTION OF THE PREFERRED EMBODIMENTS

Figure 1:
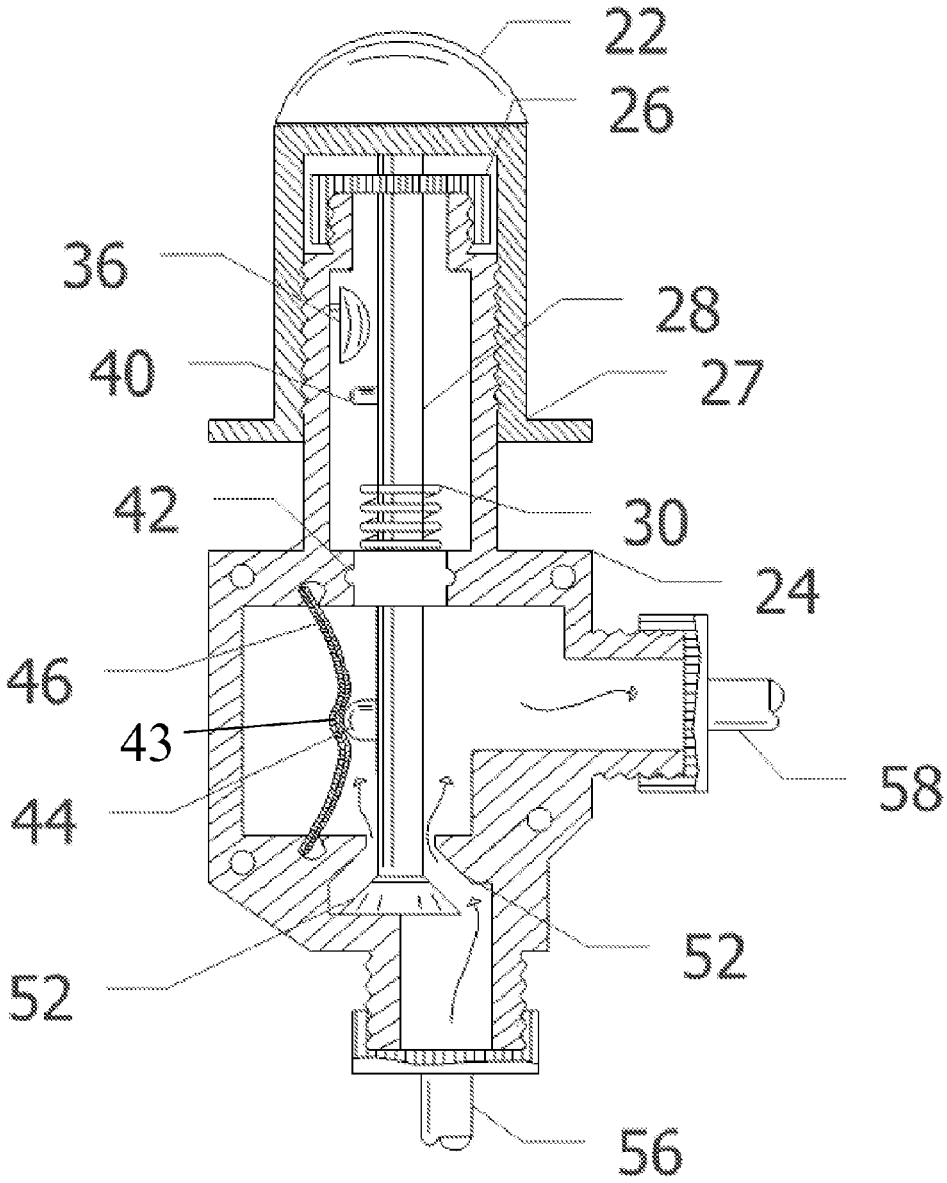
FIG. 1 illustrates a sectional view of a purge valve having a snap thermostatic element, and being in open position, according to an embodiment of the invention.

What follows is a detailed description of the preferred embodiments of the invention in which the invention may be practiced. Reference will be made to the attached drawings, and the information included in the drawings is part of this detailed description. The specific preferred embodiments of the invention, which will be described herein, are presented for exemplification purposes, and not for limitation purposes. It should be understood that structural and/or logical modifications could be made by someone of ordinary skills in the art without departing from the scope of the invention. Therefore, the scope of the invention is defined by the accompanying claims and their equivalents.

FIG. 1 illustrates a sectional view of a purge valve having a snap thermostatic element, and being in open position, according to an embodiment of the invention. This is a push-to-activate purge valve. The valve cap 22 may be a push type "button," which may be activated by a user by pushing it down, for a vertically mounted valve, or pushing it in, for a horizontally mounted valve, when the user wishes to purge cool water from a hot water line in association with which the purge valve is installed. In this motion, the valve shaft 28, which is coupled with the valve cap 22, moves freely and smoothly as guided by corresponding openings (not shown) in the mounting cap 27, shaft guide cap 26 and shaft seal 42. Consequently, the exemplary "plunger" type valve seal-seat assembly 52 creates the opening necessary for the water to flow from the valve inlet 56 to the valve outlet 58.

The valve inlet 56 is connected to the hot water line, from which cool water may need to be purged, and the valve outlet 58 is connected to one or more recycling systems, examples of which will be described later herein. Additional things happen when a user pushes the valve cap 22. The coil type spring 30 becomes compressed, and thus, the tension in it increases. Also, the shaft lock 44, which is associated with the valve shaft 28, locks into the corresponding lodging concavity 43 of the snap thermostatic element 46, a bimetallic disc type element, and thus, the valve is held in an open or on position for as long as the water temperature is below a predetermined level (e.g., 90 degrees Fahrenheit).

Figure 2:
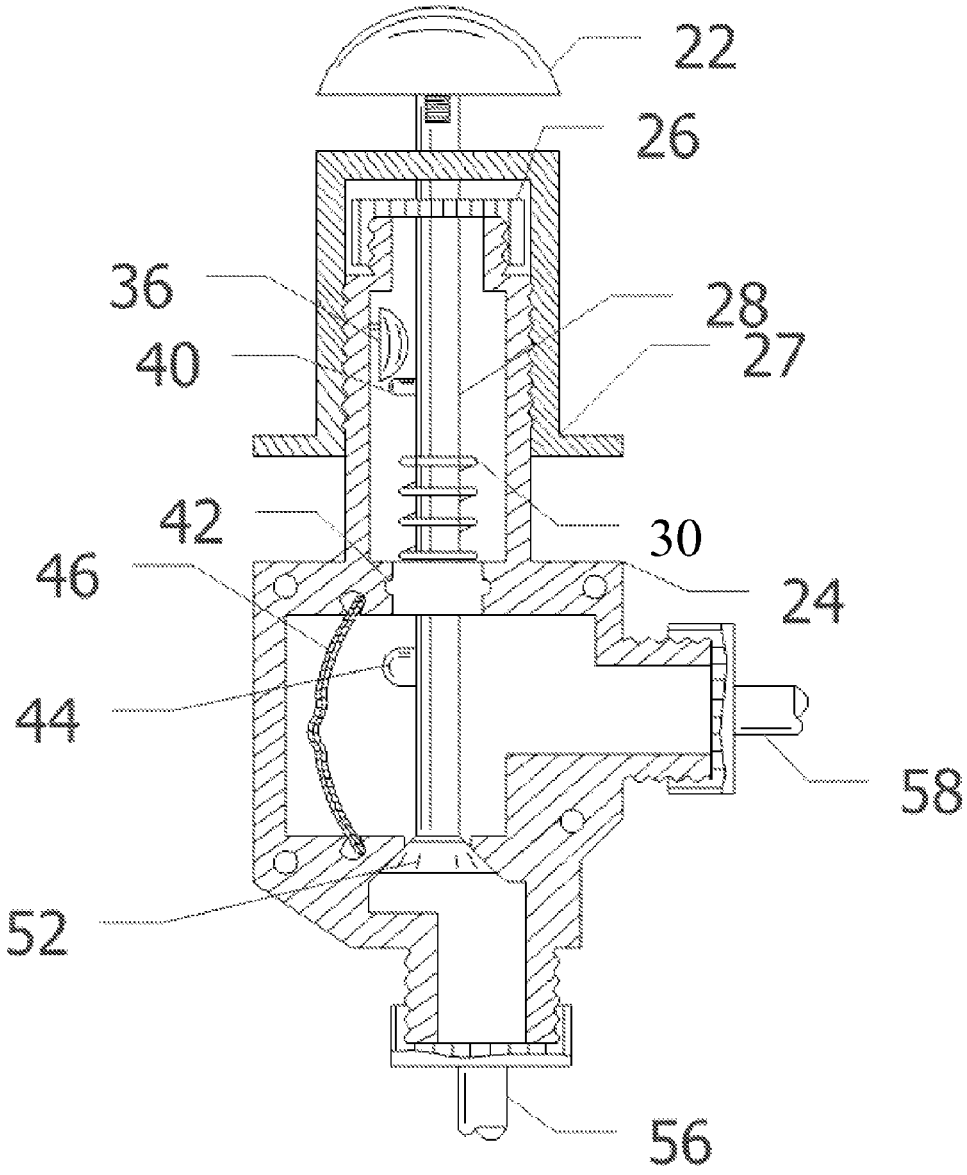
FIG. 2 illustrates the purge valve from FIG. 1 in closed position.

The predetermined water temperature level is established by calibrating the snap thermostatic element 46 to snap, at the desired temperature level, away from the shaft lock 44, as shown in FIG. 2, thereby allowing the valve to spring to a closed position under the influence of the tensioned spring 30.

During the valve's spring to a closed position, or at the end of that movement, the bell strike 40, which is coupled with the movable valve shaft 28, strikes the bell 36, which is coupled with the stationary valve body 24, thereby alerting the user that the purging cycle ended and hot water is available in the water fixture which the purge valve is associated with.

The design of the locking mechanism, comprising the snap thermostatic element 46 and the shaft lock 44, allows the user to manually cancel the purge cycle, with minimal effort, by pulling upward/outward on the valve cap 22, and thus, releasing the shaft lock from the lodging concavity 43. While alternative equivalent locking mechanisms may be used, they should preserve this option for the user, who may need to stop the purging process early for various reasons such as lack of time to use the hot water as initially intended. Therefore, the locking mechanism should be also calibrated for easy deactivation by effortlessly pulling on the valve cap 22.

Furthermore, while, for illustration purposes, a circular valve cap 22 is depicted here, one of ordinary skills in the art would recognize that alternative shapes may be used, such as, star-like shape, triangular shape, and/or that the exterior surface of the valve cap 22 may be finished in various standard ways to provide the necessary grip for an effective and effortless pulling/deactivation operation.

Again, the purge valve may be connected to hot water piping for the purpose of purging the water from the respective pipe that has cooled during non use to below a predetermined valve temperature set point (e.g. 90 degrees Fahrenheit (fixed set point), or 80-120 degrees Fahrenheit (user adjustable set point)). When the water is below the temperature set point, the snap thermostatic element 46 snaps to the right (FIG. 1) and the valve is ready for normal operation by pushing down on the valve cap 22.

It should be noted that, the valve cap 22 may be labeled as "Push", "Purge", "On", "On/Off", "Purge On/Off", "Push On/Off", or other appropriate verbiage, signs, or symbols indicating the valve purpose and operation.

In the example presented here (FIGS. 1 and 2), a coil type spring 30 is used, which is associated with the stationary valve body 24 at one end and with the movable valve shaft 28 at the other end. The spring mechanism, no matter the type employed, serves to provide the upward force necessary to cause the valve seal-seat assembly 52 to create a tight seal (see FIG. 2) such that when closed no flow is present between purge valve inlet 56 and purge valve outlet 58.

The shaft seal 42 may be any standard seal, made of rubber or the like, which is capable of preventing the water from entering the portion of the valve body 24 where the spring 30, the bell strike 40 and the bell 36 are housed. As shown, it may be feasible to use a cylindrical or round type valve seal 42. However, alternate types and materials for the valve seal 42 may also be employed and may include but are not limited to flat, square, hemispherical, rectangular, triangular, octagonal, or o-ring seal types.

It should be understood that the valve mechanical or aesthetic design shall not be limited to the illustrated example and may incorporate a plurality of design variations inasmuch as they accomplish the fundamental functionality and purpose of the purge valve as described above.

FIG. 2 illustrates the purge valve from FIG. 1 in closed position. It represents, as described above, the position of the purge valve when the purge cycle has been completed and the valve has automatically closed. Water passing through the purge valve has become hot since the cool water slug contained within the associated hot water piping has been completely purged. The hot water flowing across the bimetal snap thermostatic element 46 has caused the bimetal to actuate and snap to the left position. In this motion, the shaft lock 44 is released, tension in the coil type spring 30 pulls upward on the valve shaft 28 until the valve seal-seat assembly 52 forms tight seal terminating flow; the bell strike 40, being associated with valve shaft 28 comes in contact with bell 36 producing an audible signal indicating the valve has closed and hot water is available. All the other elements of the valve depicted in FIG. 2 are the same as in FIG. 1 described above.

Figure 3:
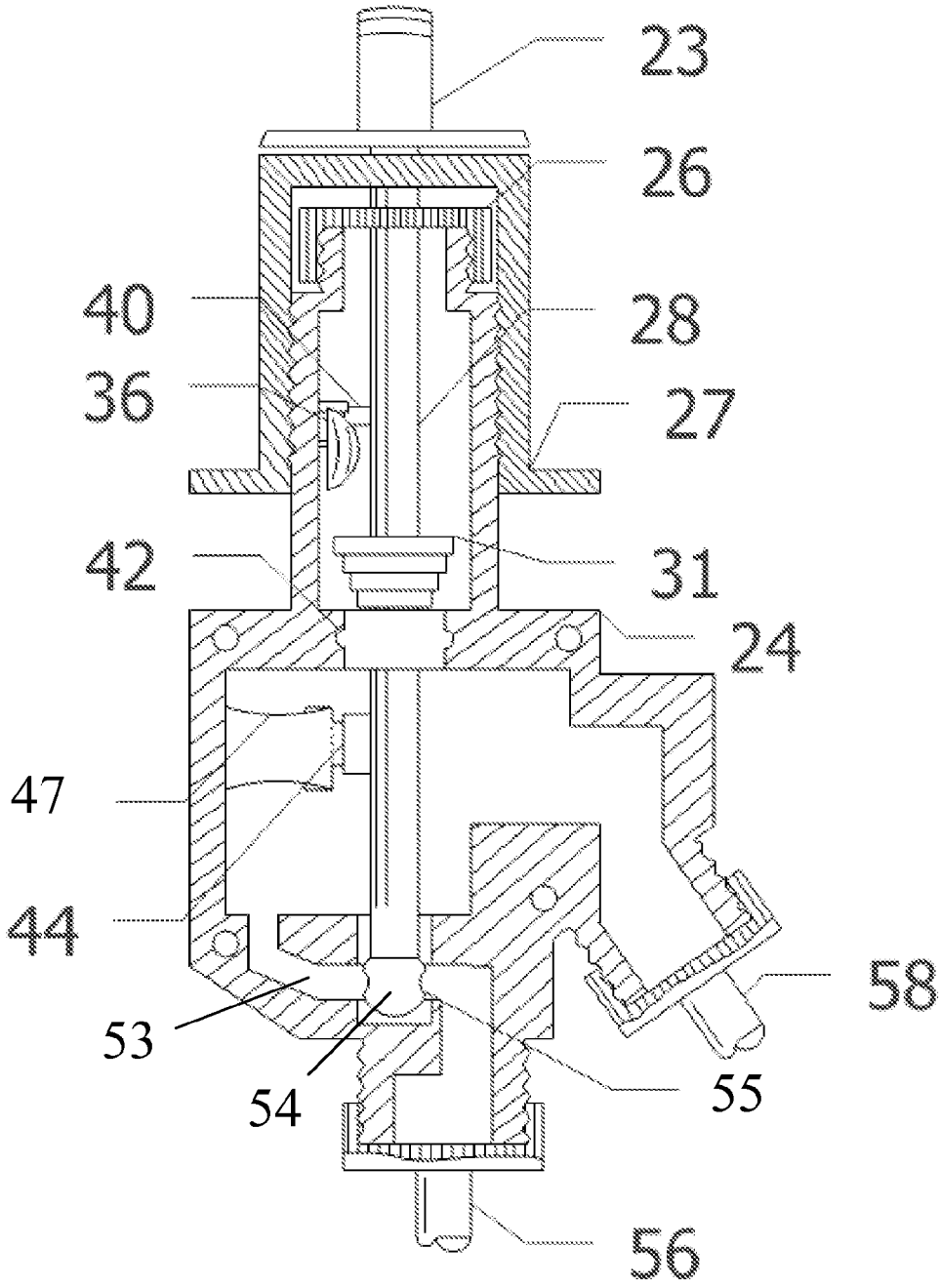
FIG. 3 illustrates a sectional view of a purge valve having a band thermostatic element and being in open position, according to another embodiment.

FIG. 3 illustrates a sectional view of a purge valve having a band thermostatic element and being in open position, according to another embodiment. The purge valve depicted here is an alternative embodiment using a twist-to-activate (90 degrees) type design. This purge valve, unlike the purge valve depicted in FIGS. 1 and 2, comprises a twist type ("knob") valve cap 23, a band type thermostatic bimetal element 47, a scroll type spring 31, and a ball type valve seat 54. All the other depicted elements of this purge valve are the same as in FIGS. 1 and 2.

The valve is shown here activated and open, which a user may accomplish by twisting valve cap 23 90 degrees, when she wishes to purge the cool water from the associated hot water pipe. By twisting the valve cap 23, the opening 55 through valve ball 54 is aligned with the water channel 53 in the valve body 24, and thus, the water is allowed to flow from the valve inlet 56, past band type thermostatic element 47, to valve outlet 58. The valve is locked in the open position by shaft lock 44 (see FIG. 5 for locking details).

When the element 47 senses hot water of a predetermined temperature level corresponding to the element's calibration, it will compress (to the left in FIG. 3), and thus, release the shaft lock 44, thereby allowing the valve to spring back (90 degrees) to the close position. This will automatically stop the flow of water from valve inlet 56 to valve outlet 58, thus, ending the purge cycle.

As with the purge valve depicted in FIGS. 1 and 2, there is no need for the user to be present or do anything to stop the purging cycle at the preset temperature. This is very important because it prevents hot water from being wasted when the user is not available to stop the purging process. However, as described earlier, the user has the option to end the purging cycle at any time, in this case by twisting the valve cap 23 back with 90 degrees. Appropriate markings such as arrows and numbers may be present on the valve cap 23 and/or the mounting cap 27 in order to guide the user. Again, as described earlier, the user will be alerted by the bell 36 which is struck by the bell strike 40 when the purge cycle ended automatically or by user's action.

In the example presented here (FIG. 3), a scroll type spring 31 is used, which is associated with the stationary valve body 24 at one end and with the movable valve shaft 28 at the other end. The spring mechanism, no matter the type employed, serves to provide here the twisting force necessary to cause the ball type valve seat 54 to spring back to the closed position when the shaft lock 44 is released.

Figure 4:
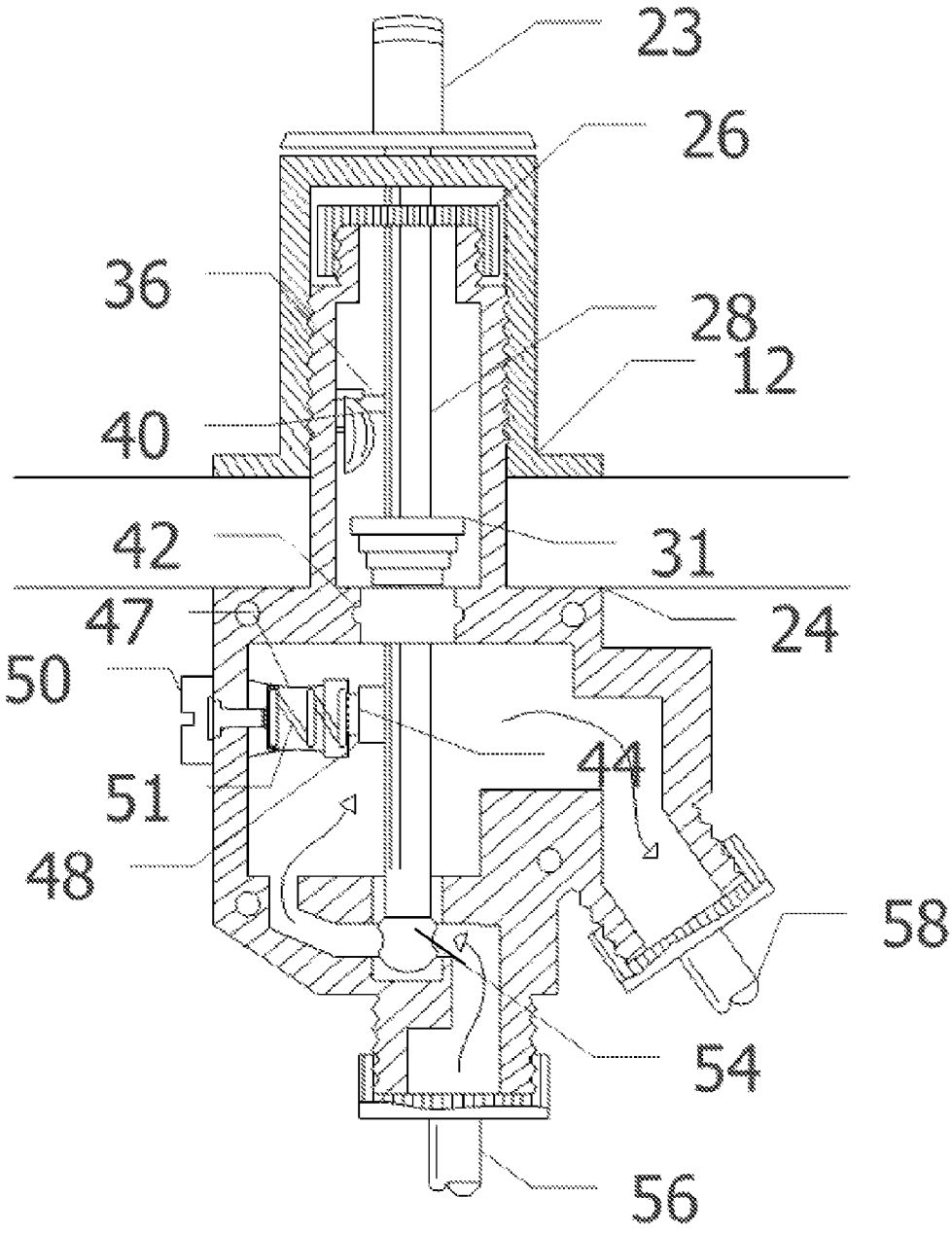
FIG. 4 illustrates the purge valve from FIG. 3 equipped with a temperature adjustment mechanism, according to another embodiment.
Figure 5:
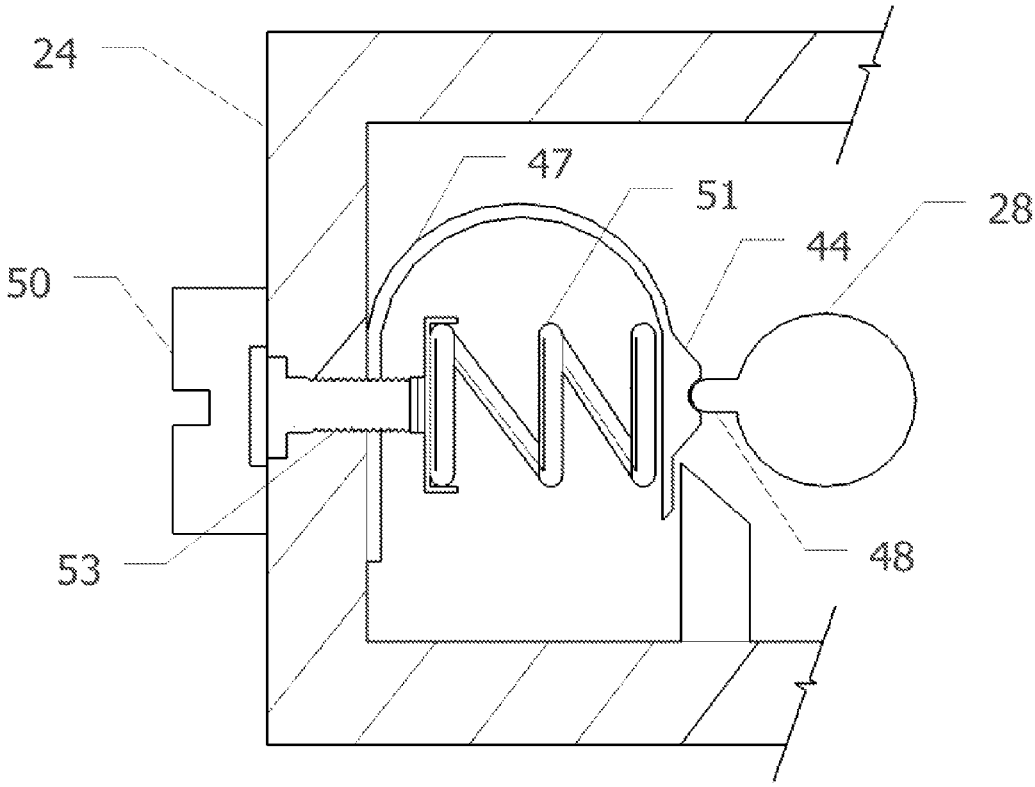
FIG. 5 is a closer top view of the temperature adjustment mechanism from FIG. 4.

FIG. 4 illustrates the purge valve from FIG. 3 equipped with a temperature adjustment mechanism, according to another embodiment. The temperature adjustment mechanism, which is closer depicted in FIG. 5, is comprised of the temperature adjustment dial 50 and the adjustable resistance spring 51. The dial 50 may be mounted on the side of the valve body 24 and may be turned by the user to adjust temperature at which the purge water cycle ends. Turning the dial 50 in one direction or an opposite direction increases or decreases the pressure on the band type thermostatic element 47 thru the adjustable resistance spring component 51, thereby increasing or decreasing the point at which the thermostatic element 47 will release the shaft lock 44, from locking with the shaft appendage 48 (see FIG. 5), causing the valve to close.

FIG. 5 depicts the purge valve in the open position where the shaft 28 has been turned 90 degrees counterclockwise to engage shaft appendage 48 to groove feature of shaft lock 44 of the thermostatic element 47. As the hot water begins to flow thru the concavity containing these components, the thermostatic element 47 compresses against adjustable resistance spring 51 and at the calibrated temperature release shaft 28 and shaft appendage 48 to allow valve to close automatically clockwise 90 degrees.

The temperature adjustment mechanism gives the option to the user to set the temperature level at which the purge valve closes, and thus, ends the purge cycle. The temperature adjustment mechanism may be calibrated in conjunction with the thermostatic bimetal element 47 to offer any desired temperature ranges, such as between 90 and 110 degrees Fahrenheit. Appropriate markings such as arrows, colored signs and numbers may be present on the temperature adjustment dial 50 and/or the valve body 24 in order to guide the user. When using this valve, before or after the valve's actuation, the user may set the dial 50 at the desired temperature, and thus, she can control the temperature of the hot water which will be available to her in the associated hot water line at the end of the purge cycle.

Figure 6A:
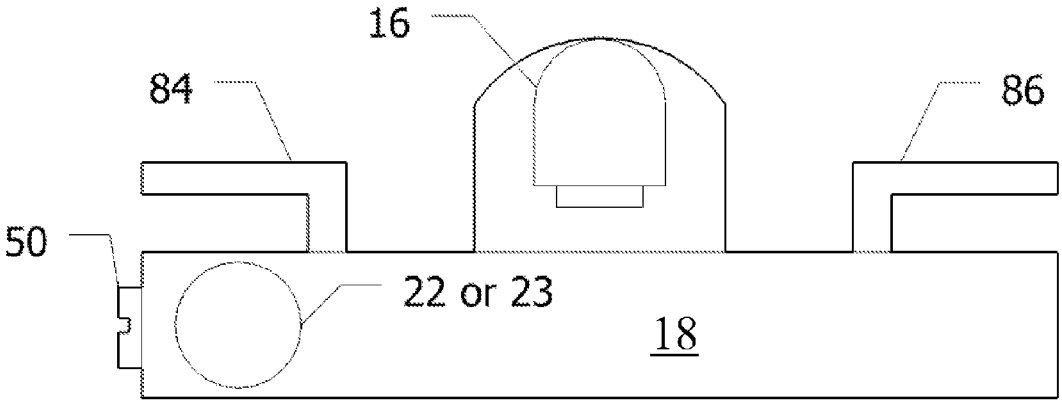
FIG. 6*a* illustrates a front view of a typical faucet adapted to incorporate a purge valve, according to another embodiment.

FIG. 6*a* illustrates a front view of a typical faucet, having a typical hot water valve 84, a typical cold water valve 86 and a water discharge element 16, adapted to incorporate a purge valve as described above, according to another embodiment ("green faucet"). It should be apparent that the two valves 84 and 86 may be combined into one, as it is common in many standard faucets, while still preserving the user's ability to regulate both, hot and cold water flow. It should also be apparent that the faucet may be configured solely for discharge of hot water, and thus, the cold water valve 86 may be absent.

As suggested in this example, it may be preferred to install the purge valve inside the body of the faucet 18, with the exception of the valve cap 22 (push type "button"; see FIG. 1) or 23 (twist type; see FIG. 3), and if applicable, as described above, the temperature adjustment dial 50. This arrangement provides functionality, by facilitating user's easy access to the valve cap 22, and if applicable, the temperature adjustment dial 50, but also esthetic appearance of the adapted faucet by hiding the purge valve's components that do not need to be accessed by the user.

The valve cap 22 may be, as described above, a push type "button," a twist type "knob" or other types of activation elements that work well with the particular functional configuration of the purge valve and are also esthetically pleasant. As described earlier, the temperature adjustment dial 50 and the underlying temperature adjustment mechanism, while optional, it has the benefit of giving the option to the user to set the temperature at which the purge cycle will end and implicitly the temperature of the hot water available in the associated faucet at the end of the purge cycle. Thus, a faucet adapted to incorporate a purge valve, which has a temperature adjustment mechanism, may be preferred given the additional benefit it offers.

It should be understood that while in FIG. 6*a*, for exemplification purposes, the valve cap 22 is shown to be positioned on the front-left and the temperature adjustment dial 50 is shown on the left side of the faucet body 18, alternative arrangements may be selected. For example, the valve cap 22 could be positioned on the top side and the dial 50 could be on the front-left side of the faucet body 18. Also, it should be noted that having a faucet with an integrated, built-in purge valve may be preferred in certain circumstances such as during new construction. However, the purge valve may be installed separately, as an add-on next to an existing standard faucet.

The valve cap 22, the temperature adjustment dial 50, and/or the corresponding portions of the faucet body 18 may have appropriate signage (i.e., numbers, arrows, colored symbols, etc). The signage may guide the user for easy use of the purge valve.

Figure 6B:
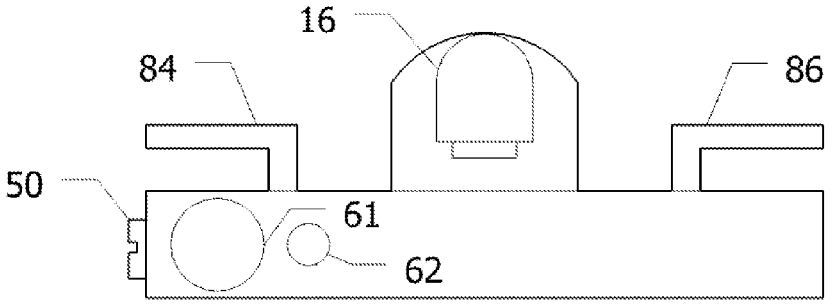
FIG. 6*b* is a diagram of an electronic faucet incorporating the purge valve ("electronic green faucet").
Figure 6C:
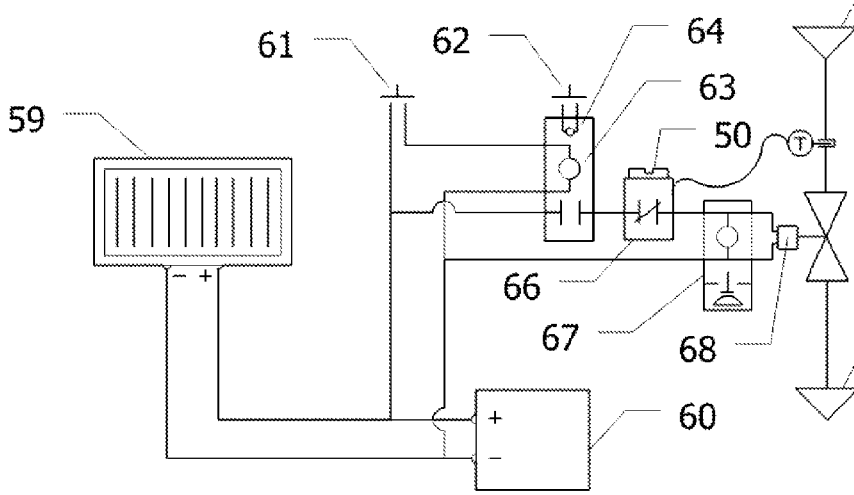
FIG. 6*c* is a diagram of an exemplary electronic circuit which may be used in an electronic green faucet.
Figure 6D:
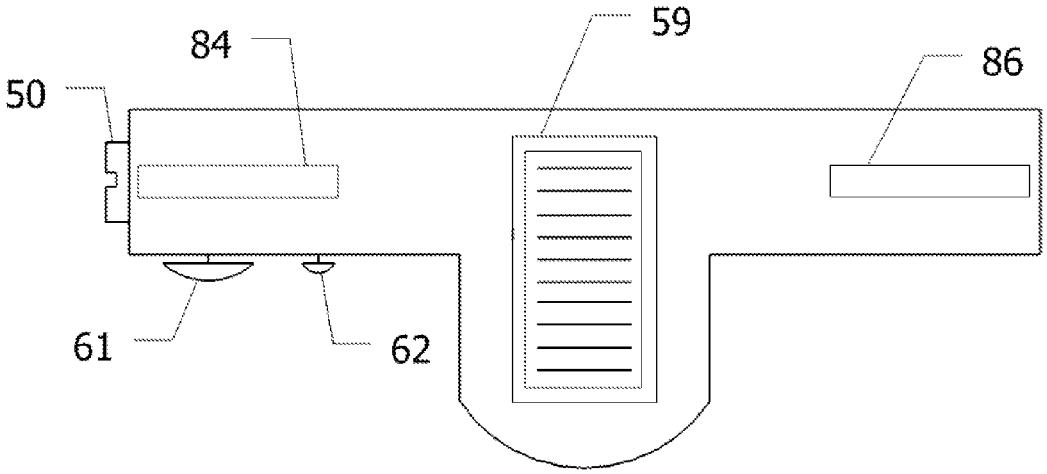
FIG. 6*d* is a top view diagram of the electronic green faucet from FIG. 6*b*, incorporating a solar collector.

FIG. 6*b* is a diagram of an electronic faucet incorporating the purge valve ("electronic green faucet"). FIG. 6*c* is a diagram of an exemplary electronic circuit which may be used. The electronic green faucet is a variation of the green faucet depicted in FIG. 6*a* such that the intent of the present invention may be carried out with simple electronic means. An assembly is shown here utilizing a small battery 60 contained within the faucet assembly and a solar collector 59 installed preferably on the upper side of the faucet assembly (as shown in FIG. 6*d*). However the faucet may also be powered from an AC power source via a step down transformer.

When purge cycle push button 61 is depressed momentarily by the user, the time delay relay 63 coil is energized and closes the associated normally open contact therein. This relay being a delay-on-break relay shall remain energized with contact closed for, for example, 5 minutes (adjustable) to allow the purge valve to complete a normal cycle. However, the relay 63 will shut off the valve automatically after the set time (e.g., 5 minutes). This is important for the event when there is no hot water available due to water heating equipment failure.

When time delay relay 63 contact is closed, power is available to continue through the normally closed contact of aquastat 66 and energize the normally closed water solenoid valve 68, thus allowing flow between purge inlet 56 and purge outlet 58. Power is also provided to chime 67. The chime 67 will sound only at the moment the power is removed from this device. When aquastat 66 senses water temperature above predetermined set point, aquastat 66 contact opens terminating flow and terminating the purge cycle. If hot water fails to flow through the valve after 5 minutes (adjustable) the time delay relay 63 will automatically cancel the purge cycle. When power is removed from chime 67 a sound will notify the user that the purge cycle has been completed. In addition, momentarily pressing cancel button 62 will send a signal to cancel feature 64 causing the immediate opening of the time delay relay 63 contact, thus, terminating the purge cycle.

It should be noted that an aquastat temperature adjustment dial 50 may also be incorporated for user adjustment of purge valve set point.

FIG. 6*d* is a top view diagram of the electronic green faucet from FIG. 6*b*, incorporating a solar collector 59. It depicts an example of how a solar collector 59 may be installed on top of a green faucet assembly in order to eliminate the need to connect to AC power.

Figure 6E:
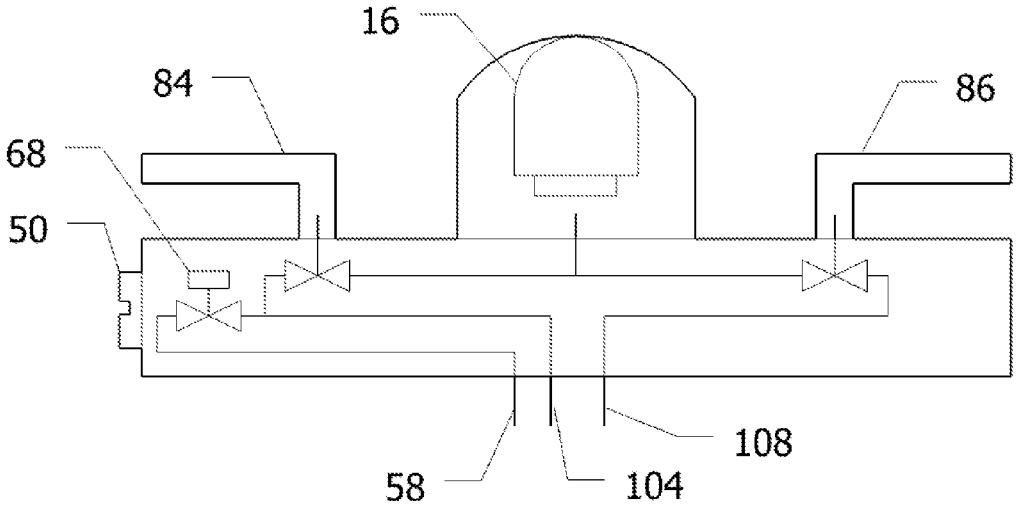
FIG. 6*e* is a diagram which shows an example of the internal water conduit of the electronic green faucet.

FIG. 6*e* is a diagram which shows an example of the internal water conduit of the electronic green faucet. As shown, the water solenoid valve 68, which functions as described above, is installed between the hot water inlet 104 and the faucet's hot water valve 84. The water solenoid valve 68 also communicates with the purge valve outlet 58. The cold water inlet 108 communicates with the cold water valve 86 as it normally does in a typical faucet.

Figure 7:
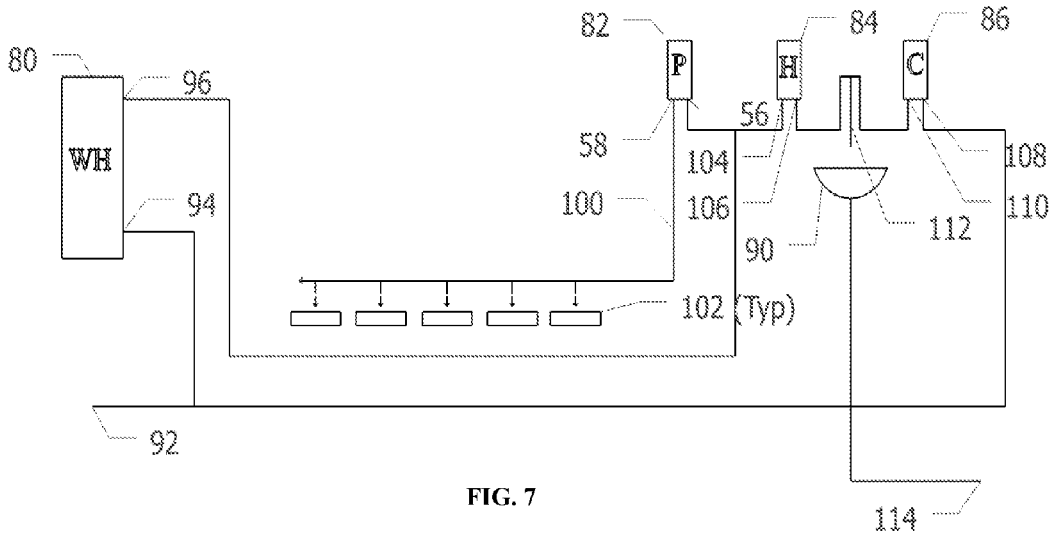
FIG. 7 is a diagrammatic view of a typical hot water system adapted to incorporate a purge valve and a conduit element for conveying the purged water to an alternative use location, according to another embodiment.

FIG. 7 is a diagrammatic view of a typical hot water system adapted to incorporate a purge valve and a conduit element for conveying the purged water to an alternative use location, such as a garden, according to another embodiment. A user may pipe purged water to a garden 102, which would then be fed whenever the purge valve is activated. As shown in FIG. 7, the purge valve 82 is preferably installed local or adjacent to any hot water fixture(s) which are not located in close proximity to the water heating source (e.g., a boiler) 80 and where the resulting volume of water contained within the hot water plumbing between water heater outlet 96 and water fixture 112 is determined to be an appreciable amount such as to warrant use of a water/energy conservation measure.

It can be assumed that during periods of non use the temperature of the volume of water within the insulated hot water piping between water heater outlet 96 and hot water line tee 98 shall eventually equalize to near ambient temperatures due to natural heat exchange through piping and insulation. When hot water is required at the typical water fixture 112, the user shall first manually activate the purge valve 82. Hot water shall then begin to flow based on pressure of building cold water supply 92, in water heater inlet 94, out water heater outlet 96, in purge valve inlet 56, out purge valve outlet 58, and exiting purge valve outlet standpipe 100 to an outdoors area. For example, the purged slug of cool water may be delivered to a lawn or garden 102. Once the purge cycle is completed, the purge valve 82 shall automatically close, as described earlier, terminating flow to the purge valve standpipe 100. Furthermore, when the purge valve 82 closes, as also described earlier, a bell within the valve sounds indicating purge cycle is complete and consequently that hot water is available at hot water tee 98 for use at local fixture hot water valve 84.

It should be noted that in the absence of purge valve 82, when hot water is required at water fixture 112, the user must open hot water valve 84 allowing water to flow based on pressure of building cold water supply 92, in water heater inlet 94, out water heater outlet 96, in hot water valve inlet 104, out hot water valve outlet 106, out water fixture 112, into sink (not shown) or drain 90, and out to sewer 114. Typically, the user is not aware of the exact moment at which hot water is available; therefore heated water may proceed to flow unused to sewer 114, wasting firstly water resources, and secondarily, the energy resources used in heating the water.

As shown in FIG. 7, the water fixture 112 may also have a cold water valve 86 with its inlet 108 and outlet 110.

Figure 8:
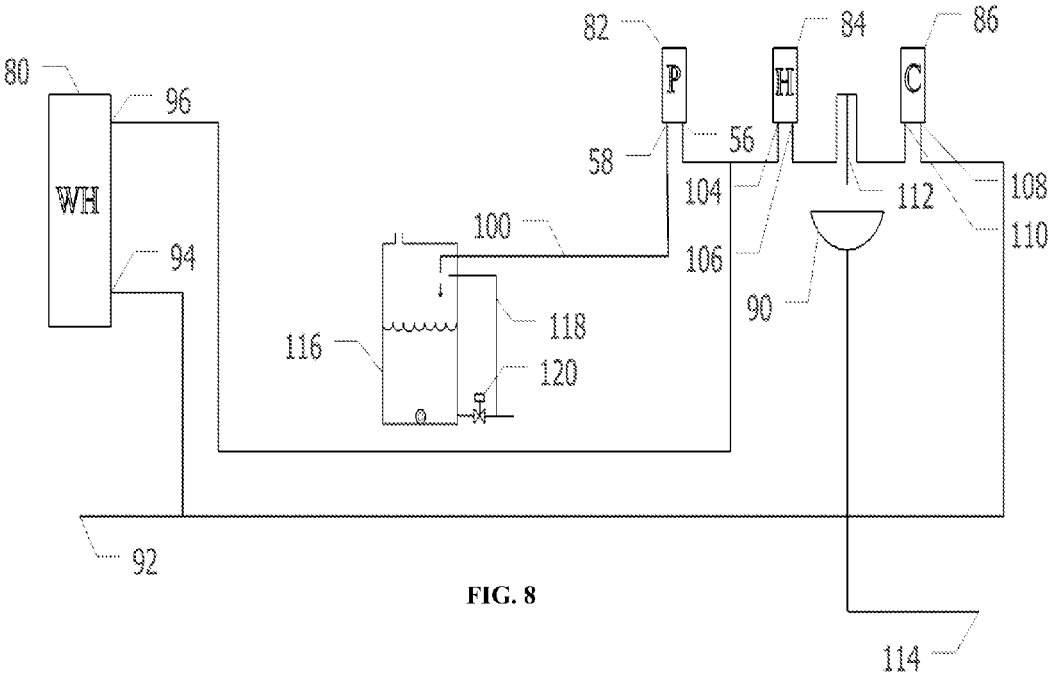
FIG. 8 is a diagrammatic view of a typical hot water system adapted to incorporate a purge valve and a storage tank for the purged water, according to another embodiment.

FIG. 8 is a diagrammatic view of a typical hot water system adapted to incorporate a purge valve and a storage tank for the purged water, according to another embodiment. FIG. 8 is identical with FIG. 7 except that in this example the purge valve outlet piping to outdoors 100 is shown as running to a storage container 116. A storage container allows the selective use of diverted purge water by the user. The purged water enters the holding or storage container 116, located preferably outside, at atmospheric pressure. To use the water stored in the container, the user can open spigot valve 120 located at bottom of container 116 to direct water by hose, pipe or irrigation system to alternate usages. As shown, the storage container 116 may be equipped with a storage tank overflow pipe 118 to allow the water from the container to flow automatically to an alternative use destination when the water reaches the overflow level in the container.

It should be noted that while, for illustration purposes, in FIGS. 7 and 8 the purge valve 82, the hot and cold water valves 84, 86 and the water fixture 112 are depicted separately, they may be integrated in a single faucet, such as a kitchen or bath faucet, as depicted in FIG. 6*a* and described above when referring to FIG. 6*a*.

It may be advantageous to set forth definitions of certain words and phrases used in this patent document. The term "couple" and its derivatives refer to any direct or indirect communication between two or more elements, whether or not those elements are in physical contact with one another. The terms "include" and "comprise," as well as derivatives thereof, mean inclusion without limitation. The term "or" is inclusive, meaning and/or. The phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like.

Although specific embodiments have been illustrated and described herein for the purpose of disclosing the preferred embodiments, someone of ordinary skills in the art will easily detect alternate embodiments and/or equivalent variations, which may be capable of achieving the same results, and which may be substituted for the specific embodiments illustrated and described herein without departing from the scope of the invention. Therefore, the scope of this application is intended to cover alternate embodiments and/or equivalent variations of the specific embodiments illustrated and/or described herein. Hence, the scope of the invention is defined by the accompanying claims and their equivalents. Furthermore, each and every claim is incorporated as further disclosure into the specification and the claims are embodiment(s) of the invention.

What is claimed is:

1. A faucet comprising a hot water inlet, hot water flow regulating means, a water discharge element, and a purge system, wherein said purge system comprises:

a solenoid valve installed inside the body of the faucet and between the hot water inlet of the faucet and said hot water flow regulating means of the faucet, such that the solenoid valve communicates with the hot water inlet of the faucet and a purge outlet; and means for controlling the opening and closing of said solenoid valve based on the temperature of the water flowing through said solenoid valve, wherein the means for controlling the solenoid valve comprise actuating means which are associated with the exterior surface of the body of the faucet and are operable by the user of the faucet.

2. The faucet of claim 1 further comprising time based means for controlling the opening and closing of said solenoid valve.

3. The faucet of claim 1 further comprising means for alerting a user that said solenoid valve has closed or opened.

4. The faucet of claim 1 wherein the means for controlling are powered by a rechargeable battery which is connected to a solar collector.

5. The faucet of claim 1 further comprising canceling means which allow a user to shut down said purge system at any time.

6. The faucet of claim 1 further comprising cold water flow regulating means.

7. The faucet of claim 1 further comprising means for allowing a user to adjust the temperature at which the solenoid valve closes.

8. The faucet of claim 1 wherein the means for controlling the opening and closing of said solenoid valve comprise an aquastat.

9. The faucet of claim 1 wherein said actuating means comprise a push button.

* * * * *